US005104767A

United States Patent [19]

Nakamura

[11] Patent Number: 5,104,767

[45] Date of Patent: Apr. 14, 1992

[54] IMAGE FORMING METHOD

[75] Inventor: Kotaro Nakamura, Shizuoka, Japan

[73] Assignee: Fuji Photo Film Co., Ltd., Kanagawa, Japan

[21] Appl. No.: 588,866

[22] Filed: Sep. 27, 1990

[30] Foreign Application Priority Data

Sep. 28, 1989 [JP] Japan ..... 1-253261

[51] Int. Cl.[5] ..... G03C 1/72

[52] U.S. Cl. ..... 430/138; 430/203; 430/254; 430/328; 430/330; 430/348; 430/349; 430/945; 430/964

[58] Field of Search ..... 430/138, 200, 203, 210, 430/254, 328, 330, 348, 349, 964, 945

[56] References Cited

U.S. PATENT DOCUMENTS

| | | | |
|---|---|---|---|
| 4,233,392 | 11/1980 | Friedel | 430/510 |
| 4,621,040 | 11/1986 | Viola | 430/138 |
| 4,798,741 | 1/1989 | Nelson | 430/138 |
| 4,876,170 | 10/1989 | Tamagawa et al. | 430/138 |
| 4,963,458 | 10/1990 | Ishikawa et al. | 430/138 |
| 5,043,240 | 8/1991 | Ong et al. | 430/138 |

FOREIGN PATENT DOCUMENTS 2113860 1/1982 United Kingdom .

OTHER PUBLICATIONS

Patent Abstract of Japan, vol. 12, No. 113 (M-683)(2960), Apr. 9, 1988 & JP-A-62 240586 (Seiko Instruments and Electronics Limited) Oct. 21, 1987.

European Search Report by Examiner A. J. Bacon, Dec. 7, 1990.

*Primary Examiner*—Hoa Van Le

*Attorney, Agent, or Firm*—Sughrue, Mion, Zinn, Macpeak & Seas

[57] ABSTRACT

A method of forming an image is disclosed comprising irradiating a heat-sensitive recording material with a laser beam, wherein the heat-sensitive recording material includes a support having provided thereon a light-absorbing layer containing microcapsules which encapsulate a core substance containing carbon black and a binder, and tranferring a latent image thus formed on the light-absorbing layer, in accordance with the pattern and amount of the laser beam irradiation, to an image-receiving film under pressure to thereby obtain a visible image on the image-receiving film.

13 Claims, No Drawings

IMAGE FORMING METHOD

FIELD OF THE INVENTION

The present invention relates to a method of forming an image with the use of a laser beam and, more particularly, to a method for heat-sensitive recording wherein a laser beam is utilized as a source of heat energy provided at selected regions of a light-absorbing layer containing light-absorbing substance and a binder encapsulated in frangible microcapsules.

BACKGROUND OF THE INVENTION

A heat-sensitive recording system is generally known in which a thermal head is brought into close proximity to the surface of a heat-sensitive recording material comprising a heat-sensitive coloring layer as provided on a support and scanned thereover so as to transfer the heat energy of the thermal head to the heat-sensitive coloring layer directly, or indirectly through an intervening protective layer thereby, to record or form a colored image on the heat-sensitive recording material. For instance, this technology has application to facsimiles or printers. However, in such a heat-sensitive recording process where a thermal head is closely attached to a heat-sensitive recording material and is scanned thereover, various problems often are encountered in that a faithful image could not be recorded, or the thermal head would be broken since the thermal head is abraded and worn, or the constituents of the heat-sensitive recording material adheres to the surface of the thermal head. Additionally, in the above heat-sensitive recording system using a thermal head, high-speed control in heating and cooling the heating element or elevation of the heating element density is limited because of the structural characteristic of the thermal head itself. Therefore, realization of high-speed recording or high-density and high-quality recording is often difficult in the heat-sensitive recording system.

On the other hand, in order to overcome the above-mentioned problems in the heat-sensitive recording system using a thermal head, employment of a laser beam to effect high-speed and high-density heat-recording without the need for contact between the energy source and the heat-sensitive recording material has been proposed.

One of the proposed techniques is to directly irradiate a heat-sensitive coloring layer with a laser beam to form an image thereon. In general, since the heat-sensitive coloring layer could hardly absorb visible rays and infrared rays, the technical matters relating to how the laser could be absorbed efficiently by the heat-sensitive coloring layer and to how the absorbed heat energy could be utilized efficiently in the coloring reaction are important themes addressed in the technical development of the image-forming process technology. For instance, various techniques concerning the image-forming process have been described in JP-A-50-23617, JP-A-54-121140, JP-A-57-11090, JP-A-58-56890, JP-A-58-94494, JP-A-58-134791 (corresponding to U.S. Pat. No. 4,510,512), JP-A-58-145493 (corresponding to U.S. Pat. No. 4,510,512), JP-A-59-89192 (corresponding to U.S. Pat. No. 4,529,992), JP-A-60-205182 and JP-A-62-56195 and WOP8607312A. (The term "JP-A" as used herein means an "unexamined published Japanese patent application".) However, in carrying out these illustrated proposals, heat energy necessary for coloration could be obtained only where the output power of the laser is relatively high in magnitude. As a result, it was extremely difficult to prepare a compact and inexpensive apparatus for carrying out the proposed methods. In addition, since the laser ray-absorbing substance to be contained in the heat-sensitive coloring layer is colored in accordance with the illustrated proposals, there is still another problem that the image to be recorded is a low-contrast and low-quality one. In general, most light-absorbing substances are inorganic compounds. However, almost all of them have a low light-absorbing efficiency. On the other hand, organic compounds which have a high light-absorbing efficiency and which have softer colors have not been developed to date.

On the other hand, as still another proposal for overcoming the above-mentioned problems in the prior art heat sensitive recording system methods, WOP88042-37A has proposed a means of separating a laser ray-absorbing layer from and image-forming layer. In accordance with this proposed approach, a carbon black, which is recognized to have a good laser ray-absorbing efficiency, is employed whereby the laser ray-absorbing efficiency is elevated, and the irradiated carbon black is transferred onto the synthetic polymer film as fused because of the generated heat. That is, carbon black serves as both the light-absorbing substance and the image-forming substance in this technic. However, this technic has the drawback in that a large amount of heat energy is required for purposes of fusing the synthetic polymer film, and, therefore, a low-power laser is ineffective in practicing this technic.

As mentioned above, various high-speed and high-density heat-sensitive recording materials which may be heat-recorded by use of a laser beam without the need for contact between the material to be recorded and the energy source have heretofore been proposed. However, an image-recording system capable of being effected by the use of a low-power laser had not been proposed prior to the present invention.

SUMMARY OF THE INVENTION

The object of the present invention is to overcome the problems in the prior art techniques and to provide an image forming method in which an image having a rich gradation, reproducibility and a high contrast can be formed by a high-speed and high-density recording system using a low-power laser.

Specifically, in accordance with the present invention, a method of forming an image is provided, wherein a laser beam is irradiated upon a heat-sensitive recording material comprising a support having a light-absorbing layer containing microcapsules which encapsulate a core substance containing at least a light-absorbing substance and a binder for the light-absorbing substance, and a latent image thus formed on the layer, in accordance with the pattern and amount of laser beam irradiation is transferred to an image-receiving film under pressure to obtain a visible image on the image-receiving film.

DETAILED DESCRIPTION OF THE INVENTION

The important factor for constructing a heat-sensitive recording system involving conversion of the light energy generated by a laser beam source into a heat energy, and utilizing the thus converted light-to-heat energy comprises selection of a suitable light-absorbing substance, selection of the suitable means of utilizing the heat energy and suitable stabilization of the image as recorded. As a result of extensive investigations, the present inventors have determined that a carbon black is the most suitable light-absorbing substance, and that the light-absorbing substance and the image-forming substance are most preferably the same compound for effective utilization of the heat energy.

However, in the prior art technique as illustrated in the above-mentioned WOP8804237A, the heat energy required to stably take out the image is inordinately high. That is, the illustrated conventional technical idea is not consistent with the object of the present invention, i.e., providing for low-power laser usage, and solution of the prior art problem of high power laser demands is the most important aspect in development of the technology.

The present invention stands upon the technical ground that stabilization of an image as transferred on a paper support or synthetic polymer film, which is a so-called image-receiving sheet, could be attained fully by simultaneous transfer of both a light-absorbing substance as an image-forming substance and a binder for fixing the light-absorbing substance on the image-receiving sheet. The present inventors have extensively investigated and have discovered the present invention characterized in that a light-absorbing substance and a binder are previously formed into a liquid blend having a high viscosity and thereafter encapsulated into microcapsules, and the microcapsules are then selectively heated by laser irradiation, and the thus heated microcapsule are passed through pressure rollers to rupture the walls thereof to thereby fix the light-absorbing substance and the binder onto the adjacent image-receiving sheet. While previously coating the binder on the image-receiving sheet for the purpose of fixing the light-absorbing substance on the image-receiving sheet could be considered as an alternative method, this, however, would require a superfluous heat energy for melting the binder and would be inconsistent with the energy efficiency aspect of the present invention. In accordance with the image-forming method of the present invention, the transferring efficiency is higher when the time period running from the laser irradiation to image transference under pressure is shortened. The most preferred embodiment of the image-forming method of the present invention is to irradiate the light-absorbing sheet with a laser while the sheet is preattached to an image-receiving sheet previously applied under pressure. In the case of this embodiment, as a matter of course, the image-receiving sheet is a transparent synthetic polymer film and laser irradiation is preferably applied to the side of the image-receiving sheet.

The support, which is to be coated with a laser ray-absorbing layer to form a light-absorbing sheet for use in the present invention, may be either a paper support or a synthetic polymer support, or may also be a laminate support composed of such paper and synthetic polymer supports. Any of which is suitably used in the practice of the present invention.

The carbon black to be incorporated into the light-absorbing layer for use in the present invention is not specifically limited with respect to the kind thereof. For instance, any of furnace black, channel black and thermal black can be used. Additionally, conventional light-absorbing substances can be also used as the light-absorbing substance of the present invention. Typical examples of these known light-absorbing substances include, for example, copper sulfate as described in JP-A-58-94495, cyanine dyes as described in JP-A-58-94494, benzenedithiol/nickel complexes as described in JP-A-57-11090, benzenethiol/nickel complexes as described in JP-A-54-121140, inorganic metal salts as described in JP-A-58-145493 (corresponding to U.S. Pat. No. 4,510,512), other known metal oxides, hydroxides, silicates, sulfates, carbonates, nitrates, complex compounds, cyanines, polyenes, as well as colored dyes and pigments used in the fields of paper, textile and paint industry as detailedly described, for example, in Hiroshi Horiguchi, Sousetsu Gosei Seni (General explanation of synthetic dyes), ed. by Sankyo Publishing. The examples of the colored inorganic pigments are chrome yellow, iron oxide pigment, molybdate orange, cadmium red, Prussian blue, zinc sulfide compounds, cadmium sulfide compounds and silicate compounds. The examples of the organic pigments are azo dyes such as permanent yellow R, hansa yellow R, meta-nitroaniline orange, red toner, autol orange, pigment orange R, benzidine yellow, vulcan fast yellow G, lake red P, pyrazolone red and lithol red, phtalocyanine pigment such as Cu-phthalocyanine, and anthraquinone pigments such as indanthrene blue and helio fase blue BL. The examples of the dyes are safranine, rhodamine, magenta, alizarin red, rhoduline red B, chrysoidine, acetamine orange, auramine, quinoline, euchrysine yellow, fast light yellow, stilbene yellow, azo yellow, metanil yellow, victoria green, anthraquinone green, naphtol green, methylene blue, diazo blue, naphtol blue, fast blue, xylene blue, methyst violet, bismarck brown and chrome brown. These light-absorbing substances can be added to the light-absorbing layer in suitable combination, for the purpose of elevating the absorption efficiency to the laser beam. The carbon black for use in the present invention preferably have a mean grain size of 100 millimicrons or less.

Known pigments may be added to the light-absorbing substance. For instance, one or more kinds of metal grains such as cobalt, iron or nickel grains, and pigments of metal oxides such as $TiO_2$, BaO, NiO, $Sb_2O_3$, $Cr_2O_3$, $Fe_2O_4$, $Fe_2O_3$, ZnO, CoO, $Al_2O_3$, CuO or MnO and composite blends of metal oxides thereof can be used.

The polymer substance, which is a component of the binder incorporated into the microcapsules of the present invention along with the light-absorbing substance, is not particularly limited. For instance, any of polyolefins, olefin copolymers, styrene resins, styrene-butadiene copolymers, epoxy resins, polyesters, rubbers, polyvinyl pyrrolidones, polyamides, coumaroneindene copolymers, methyl vinyl ethers, maleic anhydride copolymers, polyamides, polyurethanes, polyureas, acrylate polymers, methacrylate polymers, acrylic acid-long chain alkyl methacrylate copolymers, polyvinyl acetates and polyvinyl chlorides can be employed. These polymer substances can be used alone or as a mixture of two or more thereof. Of the above-mentioned binder polymers, especially preferred are acrylate polymers, methacrylate polymers and styrene-butadiene copolymers.

As a solvent for the components of the binder, an oil-soluble solvent can be used. Such an oil-soluble solvent is a high boiling point solvent which may dissolve or swell the above-mentioned polymers and which has a boiling point of 150° C. or higher. For example, it includes phthalates (e.g., diethyl phthalate, dibutyl phthalate), aliphatic dicarboxylates (e.g., diethyl malonate, dimethyl oxalates), phosphates (e.g., tricresyl phosphate, trixylenyl phosphate), citrates (e.g., O-acetyltriethyl citrate, tributyl citrate), benzoates (e.g., butyl benzoate, hexyl benzoate), fatty acid esters (e.g., hexadecyl myristate, dioctyl adipate), alkylnaphthalenes (e.g., methylnaphthalene, dimethylnaphthalene, monoisopropylnaphthalene, diisopropylnaphthalene), alkyldiphenyl ethers (e.g., o-, m-, p-methyldiphenyl ethers), amide compounds of higher fatty acids or aromatic sulfonic acids (e.g., N,N-dimethyllauroamide, N-butylbenzenesulfonamide), trimellitates (e.g., trioctyl trimellitate), diarylalkanes (e.g., dimethylphenylphenylmethane, 1-phenyl-1-methylphenylethane, 1-dimethylphenyl-1-phenylethane, 1-ethylphenyl-1-phenylethane, 1-isopropylphenyl-2-phenylethane), as well as chlorinated paraffins having from 8 to 30 carbon atoms and having a chlorination degree of from 10 to 40% by weight.

If desired, the above-mentioned high boiling point solvent may be used in the present invention along with other organic solvents which does not dissolve or swell the above-mentioned polymers and which have a boiling point falling within the range of from 100° to 250° C. As examples of such a low boiling point solvent, aliphatic saturated hydrocarbons or mixtures consisting essentially of aliphatic saturated hydrocarbons are examples thereof.

The binder for use in the present invention is preferably an oily composition containing three components including one of each of the above-mentioned polymer, the low boiling point solvent and the high boiling point solvent.

The weight ratio of the binder and the light-absorbing substance is preferably within the range of from 50/1 to 1/10, more preferably 20/1 to 1/1.

The wall material of the microcapsules for use in the present invention is not particularly limited. However, the material is preferably one having a glass-transition point falling within the range of from 80° to 150° C. and having a property that the microcapsule wall is made of the material which can easily be ruptured when the microcapsules are heated at a temperature falling within the said glass-transition point range under pressure, and as a substance compatible to the image-forming method of the present invention. For instance, polyureas, polyurethanes, polyamides, polyesters and epoxy resins are examples thereof.

The methods of preparing microcapsules of the present invention are described, for example, in U.S. Pat. Nos. 2,900,457, 2,800,458 and 3,111,407, and JP-B-38-19574, JP-B-42-771 and JP-B-36-9168. (The term "JP-B" as used herein means an "examined Japanese patent publication".) Hereinafter, an embodiment of preparing microcapsules of the present invention will be described below as an example of using a polyurea as a microcapsule wall material.

A method of preparing microcapsules is known, in which a microcapsule wall made of a polyurea is formed around a core substance which contains a light-absorbing substance and a binder and which is dispersed in the form of an oily drop. Such a known method can be utilized for preparing the microcapsules of the present invention.

As preferred examples, interfacial polymerization method, internal polymerization method and external polymerization method are representative.

It is known that capsule walls of polyureas may easily be formed by interfacial polymerization reaction of a polyisocyanate such as diisocyanate, triisocyanate, tetraisocyanate or polyisocyanate prepolymer and a polyamine such as diamine, triamine or tetramine, or a prepolymer containing two or more amino groups, or piperazine or a derivative thereof, along with a polyol in an aqueous solvent, whereupon polyurea microcapsule walls easily may be formed.

On the other hand, composite capsule walls made of polyureas, polyurethanes and polyamides can be formed by the following methods.

For example, polyurea/polyamide composite walls, or polyurethane/polyamide composite walls, can be prepared by an interfacial polymerization method in which a polyisocyanate and an acid chloride as well as a polyamine and a polyol are used and polymerized, whereupon the pH value of the emulsion medium of the reaction liquid is controlled, and, thereafter, the reaction system is heated for polymerization. Polyurea/-polyamide composite walls can be prepared by a polymerization method in which a polyisocyanate, an acid chloride and a polyamine are used and polymerized whereupon the pH value of the emulsion medium of the reaction liquid is controlled and thereafter the reaction system is heated for polymerization. The details of the method of preparing such polyurea/polyamide composite walls are described, for example, in JP-A-58-66948.

The walls of the microcapsules of the present invention can contain, if desired, a charge-adjusting agent such as metal-containing dyes or nigrosines as well as other known additives. Such additives may be incorporated into the microcapsule walls during formation of the walls or thereafter.

Additionally, the surfaces of the capsule walls may be graft-polymerized with vinyl monomers or the like monomers, if desired, for the purpose of adjusting the charging property of the surfaces. Alternatively, polymers of such monomers may also be attached to the surfaces of the capsule walls for the same purpose.

For coating the microcapsules formed as mentioned above on a support, any known aqueous coating system or organic solvent coating system technics can be employed as described, for example, in U.S. Pat. Nos. 2,681,294, 2,761,791, 3,508,947, 2,941,898 and 3,526,528, and U. Harasaki, Coating Engineering, published by Asakura Shoten (1973). For example, the following compounds may be used along with the microcapsules for the purpose of stably and uniformly coating the light-absorbing layer and of enhancing the strength of the coated film. Such compounds include, for example, methyl cellulose, carboxymethyl cellulose, hydroxyethyl cellulose, starches, gelatin, polyvinyl alcohol, carboxy-modified polyvinyl alcohol, polyacrylamide, polystyrene and copolymers thereof, polyesters and copolymers thereof, polyethylene and copolymers thereof, epoxy resins, acrylate and methacrylate/resins and copolymers thereof, silicone resins, polypropylene and copolymers thereof, polyurethane resins and polyamide resins. The weight ratio of the above-mentioned additional compound to the carbon black may be from 0.01/1 to 10/1. Additionally, known surfactants may also be employed, if desired, for the purpose of stably blending the microcapsules and the above-mentioned coat film-constituting agents. Examples of surfactants usable for this purpose include anionic surfactants such as alkali metal salts of sulfosuccinic acid or alkali metal salts of polystyrenesulfonic acid; nonionic surfactants surfactants such as polyoxyethylene alkylethers; and cationic surfactants such as long chain alkyltrimethylammonium salts In accordance with the present invention, it is preferred that the light-absorbing layer is coated to have a light-absorbing substance of from 0.1 to 10 g/m$^2$ as coated.

In the present invention, a transparent synthetic polymer film is preferably used as the image-receiving layer. Examples of the film include polyester films such as polyethylene terephthalate film or polybutylene terephthalate film; cellulose derivative films such as cellulose triacetate film; polyolefin films such as polystyrene film, polypropylene film or polyethylene film; as well as polyimide films, polyvinyl chloride films, polyvinylidene chloride films, polyacrylic films, and polycarbonate films. These may be used singly or as laminates composed of two or more thereof. The transparent synthetic polymer film for use in the present invention is preferably one which has a high transparency and does not absorb the laser beam as irradiated thereto and which does not deform by heat due to laser irradiation and has a high dimension stability. The thickness of the support of the film is preferably from 10 microns to 200 microns.

The laser beam which is employed in the present invention may be type having a wavelength range falling within the visible light region, near infrared region and infrared region. For instance, examples thereof include a helium-neon laser, an argon laser, a carbon dioxide gas laser, a YAG laser and a semiconductor layer.

In the method of the present invention of irradiating a light-absorbing layer with a laser beam, a latent image is formed in accordance with the irradiated target site pattern and amount. The irradiated latent image is differentiated from the non-irradiated region, since the heat as generated by the laser irradiation is imparted to the capsule walls and the capsule walls are heated up to a temperature higher than the glass-transition point thereof and become more easily broken or frangible under pressure.

In the method of the present invention, the thus formed latent image is transferred to a paper or synthetic polymer support under pressure to form a visible image thereon. As one preferred characteristic feature of the image-forming method, pressure is imparted to the light-absorbing sheet immediately after the laser irradiation (generally, within several seconds or less after irradiation treatment) so as to transfer the image.

In the method of the present invention, the pressure necessary for transferring the image is from 50 to 500 kg/cm$^2$, preferably from 100 to 300 kg/cm$^2$. It is preferred that heating is effected simultaneously with application of pressure to the sheet. The heating temperature is, though varying in accordance with the material of the microcapsule walls, preferably defined to be a temperature lower than the glass-transition temperature of the wall material polymer by about 10° to 50° C.

In accordance with the most preferred embodiment of the image-forming method of the present invention, pressure rollers which have previously been heated up to a temperature lower than the glass-transition temperature of the microcapsule wall material polymer by 10° to 50° C. are used and the light-absorbing layer of the light-absorbing sheet is tightly attached to the image-receiving sheet made of a transparent synthetic polymer film under pressure of from 100 to 300 kg/cm$^2$ with the rollers, whereupon a laser beam is irradiated upon the attached sheets through the image-receiving layer so that the laser beam may be focused at the attached interface between the light-absorbing layer and the image-receiving film, and thereafter the image-receiving sheet is peeled off from the light-absorbing sheet to obtain a recorded image. Naturally, as a matter of course, a negative image is formed on the image-receiving sheet while a positive image is formed on the light-absorbing sheet. Accordingly, the both sheets may be so planned that the both images as formed on the two sheets may be utilized, if desired. In accordance with one embodiment, not only the transference efficiency under pressure is elevated but also the irradiation energy may be economized since the temperature of the light-absorbing layer is to be already elevated prior to laser irradiation. That is, the embodiments of the present invention have many advantageous benefits.

The following example is intended to illustrate the present invention in more detail but not to be construed to restrict it in any way. Unless otherwise specifically indicated, % (percentage) is by weight in the example.

EXAMPLE 40 g of a solution prepared by blending 1-isopropylphenyl-2-phenylethane containing 50% of polyisobutyl methacrylate (trade name: Acryl Base MM-2002-2, product by Fujikura Chemical Co.) and Isopar-H (aliphatic saturated hydrocarbon mixture, product by Exon Co.) in a weight ratio of 6/5, and 3 g of an acidic carbon black (trade name: RAVEN 5000, pH 2.8: product of Colombian Carbon Japan Co.) were kneaded and dispersed in an automatic mortar to prepare a dispersion.

Separately, a solution of 20 g of an adduct comprising 3 mols of xylylene diisocyanate and one mol of trimethylolpropane (trade name: Takenate D110-N: Product by Takeda Chemical Industry Co.) as dissolved in 20 g of ethyl acetate was prepared. The solution was then blended with the above-mentioned dispersion to give an oily phase. Preparation of the oily phase liquid blend (blend of core substance and capsule wall material) was effected with adjusting the liquid temperature to be 25° C. or lower.

0.2 g of diethylene triamine was added to 200 g of an aqueous 4% solution of methyl cellulose (methoxy group substitution degree: 1.8; mean molecular weight: 15,000) to prepare an aqueous medium, which was then cooled to 15° C.

The above-mentioned oily phase liquid blend was emulsified and dispersed into the aqueous medium to obtain an oil-in-water emulsion where the oil drops had a mean grain size of about 12 microns.

About 10 minutes after preparation of the emulsion, 50 g of an aqueous 2.5% solution of diethylene triamine was gradually and dropwise added to the emulsion, which was then stirred in a thermostat of 60° C. for 3 hours to complete encapsulation.

The thus prepared capsules-containing liquid was coated on a 75-micron thick polyethylene terephthalate in a solid amount of 1.0 g/m$^2$, which was then dried at 50° C. for 30 minutes to obtain a light-absorbing sheet.

The light-absorbing sheet was wound around a heat-roller and heated at 80° C. while being irradiated with a one-msec laser beam (a helium-neon laser) with an energy of 0.1 J/cm$^2$ Next (after 0.3 second), an image-receiving sheet of a 75-micron thick polyethylene terephthalate film was lapped over the light-absorbing sheet as wound around the heat-roller and a pressure of 150 kg/cm$^2$ was imparted to the thus lapped sheets. After a peeling the image-receiving sheet from the light absorbing sheet, a transferred image was obtained.

15 minutes after the image-transference under pressure, the transferred image was rubbed with fingers, which resulted in no change in the integrity of the transferred image. In the same manner, a transferred image was also obtained by irradiation with a 0.5-msec laser. The density of the obtained transferred image portion of each sample was measured with a Mackbeth Densitometer to be 1.23 and 0.45, respectively.

While the invention has been described in detail and with reference to specific embodiments thereof, it will be apparent to one skilled in the art that various changes and modifications ca be made therein without departing from the spirit and scope thereof.

What is claimed is:

1. A method of forming an image comprising: irradiating a heat-sensitive recording material with a laser beam, wherein said heat-sensitive recording material includes a support having provided thereon a light-absorbing layer containing microcapsules which encapsulate a core substance containing carbon black and a binder; and transferring a latent image thus formed on the light-absorbing layer, in accordance with a pattern and amount of laser beam irradiation, to an image-receiving film under pressure to thereby obtain a visible image on said image-receiving film.

2. A method of forming an image as in claim 1, wherein the light-absorbing layer is irradiated while said light-absorbing layer is attached to said image-receiving film.

3. A method of forming an image as in claim 1, wherein said carbon black has a mean grain size of from 100 millimicrons or less.

4. A method of forming an image as in claim 1, wherein said carbon black is selected from the group consisting of furnace black, channel black and thermal black.

5. A method of forming an image as in claim 1, wherein said carbon black is coated on said light-absorbing layer at a rate of 0.1 to 10 g/m2.

6. A method of forming an image as in claim 1, wherein said support for the light-absorbing layer is comprised of paper, synthetic polymer, or a laminate support thereof.

7. A method of forming an image as in claim 1, in which the image-receiving film is a transparent synthetic polymer film and the light-absorbing layer is irradiated from the side of the image-receiving film.

8. A method of forming an image as in claim 1, wherein said binder is an oily composition comprising a polymer, a low boiling point solvent incapable of dissolving or swelling binder polymers and a high boiling point solvent capable of dissolving or swelling binder polymers.

9. A method of forming an image as in claim 8, wherein said binder contains a polymer selected from the group consisting of polyolefins, olefin copolymers, styrene resins, styrene-butadiene copolymers, epoxy resins, polyesters, polyvinyl pyrrolidones, polyamides, coumarone-indene copolymers, methyl vinyl ethers, maleic anhydride copolymers, polyamides, polyurethanes, polyureas, acrylate polymers, methacrylate polymers, acrylic acid-long chain alkyl methacrylate copolymers, polyvinyl acetates and polyvinyl chlorides.

10. A method of forming an image as in claim 1, in which wall material of the microcapsules is selected from the group consisting of a polyurea, polyurethane, polyamide, polyester or epoxy resin, and which has a glass transition point in the range of from 80° to 150° C. and which may be ruptured when heated at a temperature falling within said glass-transition temperature range under pressure.

11. A method of forming an image as in claim 1, wherein said laser beam is generated from a laser source selected from the group consisting of a helium-neon laser, an argon laser, a carbon dioxide laser, a YAG laser and a semiconductor laser.

12. A method of forming an image as in claim 1, wherein said latent image transferring pressure is from 50 to 500 kgs/cm$^2$.

13. A method of forming an image as in claim 1, wherein pressure rollers have been previously heated to a temperature lower by 10° to 50° C. than the glass-transition temperature of the microcapsule wall material polymer, and the light-absorbing layer is preattached to the image-receiving film made of a transparent synthetic polymer film under a pressure of from 100 to 300 kg/cm$^2$ with said rollers, whereafter a laser beam is irradiated upon the attached sheets through the image-receiving layer in manner such that the laser beam may be focused at the interface between the light-absorbing layer and the image-receiving film, and thereafter the image-receiving sheet is peeled off from the light-absorbing sheet to obtain a recorded image.

* * * * *